US008941632B2

(12) United States Patent
Kim et al.

(10) Patent No.: US 8,941,632 B2
(45) Date of Patent: Jan. 27, 2015

(54) LIQUID CRYSTAL DISPLAY DEVICE AND DRIVING METHOD FOR CHANGING DRIVING MODE THEREOF

(75) Inventors: Minki Kim, Gyeongbuk (KR); Jinsung Kim, Gyeongbuk (KR); Hayoung Ji, Gyeongbuk (KR)

(73) Assignee: LG Display Co., Ltd., Seoul (KR)

( * ) Notice: Subject to any disclaimer, the term of this patent is extended or adjusted under 35 U.S.C. 154(b) by 280 days.

(21) Appl. No.: 13/305,903

(22) Filed: Nov. 29, 2011

(65) Prior Publication Data

US 2012/0133628 A1 May 31, 2012

(30) Foreign Application Priority Data

Nov. 30, 2010 (KR) ..... 10-2010-0120350

(51) Int. Cl.
*G09G 3/36* (2006.01)

(52) U.S. Cl.
CPC ..... *G09G 3/3677* (2013.01); *G09G 3/3614* (2013.01); *G09G 3/3688* (2013.01); *G09G 2310/027* (2013.01); *G09G 2310/0297* (2013.01); *G09G 2330/022* (2013.01); *G09G 2330/023* (2013.01); *G09G 2370/08* (2013.01)
USPC ..... 345/208; 345/94; 345/204; 345/100

(58) Field of Classification Search
CPC ..... G09G 3/36; G09G 3/3677
USPC ..... 345/87–100, 204–208, 211–213; 368/90–109
See application file for complete search history.

(56) References Cited

U.S. PATENT DOCUMENTS

| | | | | |
|---|---|---|---|---|
| 5,107,469 | A * | 4/1992 | Dodson | 368/109 |
| 2001/0030645 | A1* | 10/2001 | Tsutsui et al. | 345/211 |
| 2002/0126107 | A1* | 9/2002 | Inoue et al. | 345/204 |
| 2003/0052873 | A1* | 3/2003 | Ueda | 345/211 |
| 2003/0193459 | A1* | 10/2003 | Kim et al. | 345/87 |
| 2004/0021625 | A1* | 2/2004 | Lee | 345/87 |
| 2004/0080500 | A1 | 4/2004 | Koyama | |
| 2006/0022929 | A1* | 2/2006 | Hashimoto et al. | 345/96 |

(Continued)

FOREIGN PATENT DOCUMENTS

| | | | |
|---|---|---|---|
| CN | 1497517 | | 5/2004 |
| CN | 1728230 | A | 2/2006 |
| CN | 101067922 | A | 11/2007 |
| CN | 101334971 | A | 12/2008 |

OTHER PUBLICATIONS

Chinese Office Action for Chinese Application No. 201110386789.5 dated Sep. 3, 2013.

(Continued)

*Primary Examiner* — Srilakshmi K Kumar
*Assistant Examiner* — James Nokham
(74) *Attorney, Agent, or Firm* — Morgan, Lewis & Bockius LLP

(57) ABSTRACT

The present invention provides a LCD device including: a timing control unit; an oscillator which is included in the timing control unit and generates a clock frequency; a frequency divider which is included in the timing control unit and reduces the clock frequency supplied from the oscillator by dividing the clock frequency by at least 2; and a mode selection part which is included in the timing control unit and changes at least one driving mode of internal logic circuits by using the divided clock frequency supplied from the frequency divider.

10 Claims, 8 Drawing Sheets

(56) References Cited

U.S. PATENT DOCUMENTS

| | | | | |
|---|---|---|---|---|
| 2007/0252803 | A1 | 11/2007 | Fukui et al. | |
| 2008/0278427 | A1 * | 11/2008 | Jang et al. | 345/98 |
| 2009/0002291 | A1 | 1/2009 | Koo et al. | |
| 2009/0002302 | A1 | 1/2009 | Koo et al. | |

OTHER PUBLICATIONS

2nd Notification of Office Action from the State Intellectual Property Office of China dated Apr. 10, 2014 in counterpart Chinese application No. 201110386789.5.

* cited by examiner

Fig. 8

| | | | | | | | |
|---|---|---|---|---|---|---|---|
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |

(a)

| | | | | | | | |
|---|---|---|---|---|---|---|---|
| − | + | − | + | − | + | − | + |
| − | + | − | + | − | + | − | + |
| + | − | + | − | + | − | + | − |
| + | − | + | − | + | − | + | − |
| − | + | − | + | − | + | − | + |
| − | + | − | + | − | + | − | + |
| + | − | + | − | + | − | + | − |
| + | − | + | − | + | − | + | − |

(b)

Fig. 9

| | | | | | | | |
|---|---|---|---|---|---|---|---|
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |
| + | + | + | + | + | + | + | + |

(a)

| | | | | | | | |
|---|---|---|---|---|---|---|---|
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |
| − | − | − | − | − | − | − | − |

(b)

LIQUID CRYSTAL DISPLAY DEVICE AND DRIVING METHOD FOR CHANGING DRIVING MODE THEREOF

This application claims the benefit of Korean Patent Application No. 10-2010-0120350 filed on Nov. 30, 2010, which is hereby incorporated by reference.

BACKGROUND

1. Field

The present invention relates to a liquid crystal display device and a driving method thereof.

2. Related Art

According to development of information technology, a display device market for a display device as a connective medium between a user and information is largely increased. Accordingly, the use of Flat Panel Displays (FPD) such as a Liquid Crystal Display (LCD), an Organic Light Emitting Diodes (OLED), a Plasma Display Panel (PDP), and the like are increased. The LCD is widely used thereamong since the LCD can obtain the high resolution and can increase or reduce a size thereof.

In a LCD device, a data driving unit and a gate driving unit are driven by a data signal, a control signal, and the like which are supplied from a timing control unit. The electric field is formed by a voltage difference due to a common voltage when the data signal, the gate signal, and the like are received from the data driving unit and the gate driving unit.

A LCD panel includes a liquid crystal layer which is positioned between a transistor substrate having a transistor, a storage capacitor, a pixel electrode, and the like and a color filter substrate having a color filter, a black matrix, and the like. The LCD panel displays an image in a manner for causing a change in the light amount provided from a backlight unit by adjusting an array direction of the liquid crystal layer by the electric field formed through the pixel electrode, the transistor substrate or the color filter substrate.

Meanwhile, the prior timing control unit drives various logic circuits with the same clock frequency in a non-signal image driving state and a normal image driving state by using a fixed oscillator clock. Accordingly, the prior LCD device needs an improvement since the same power as the normal image driving state is used in the non-signal image driving state.

SUMMARY

According to an exemplary embodiment of this document, there is provided a LCD device including a timing control unit; an oscillator which is included in the timing control unit and generates a clock frequency; a frequency divider which is included in the timing control unit and reduces the clock frequency supplied from the oscillator by dividing the clock frequency by 2; and a mode selection part which is included in the timing control unit and changes at least one driving mode of internal logic circuits by using the divided clock frequency supplied from the frequency divider.

According to an exemplary embodiment of this document, there is provided a method for driving the LCD device includes the steps of: controlling the frequency divider to reduce the clock frequency supplied from the oscillator by dividing the clock frequency by 2; and changing at least one driving mode of the internal logic circuits by using the reduced clock frequency divided by at least 2, determining a data signal as a non-signal image and a normal image, changing at least one driving mode of the internal logic circuits when the data signal is the non-signal image.

BRIEF DESCRIPTION OF THE DRAWINGS

The accompany drawings, which are included to provide a further understanding of the invention and are incorporated on and constitute a part of this specification illustrate embodiments of the invention and together with the description serve to explain the principles of the invention. In the drawings:

FIG. 8 a view illustrating a 2-dot inversion state; and

FIG. 9 is a view illustrating a frame inversion state.

DETAILED DESCRIPTION OF THE PREFERRED EMBODIMENTS

Reference will now be made in detail embodiments of the invention examples of which are illustrated in the accompanying drawings.

Hereinafter, embodiments of this document will be described with reference to the accompanying drawings.

Figure 1:
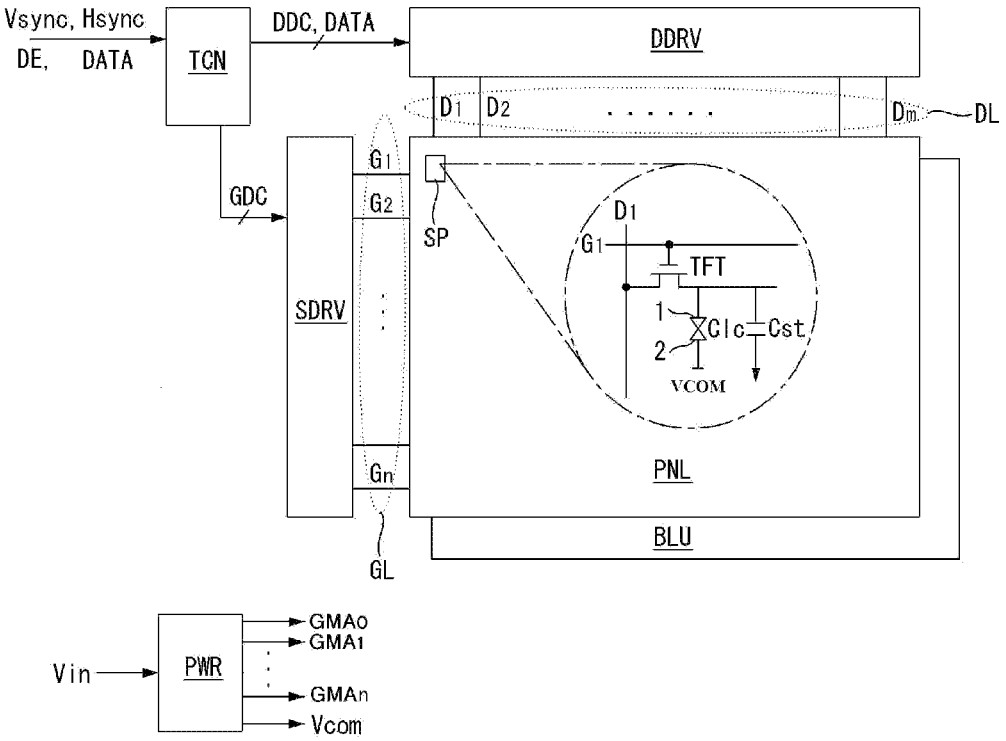
FIG. 1 is a block diagram of a LCD according to one embodiment of the present invention.
Figure 2:
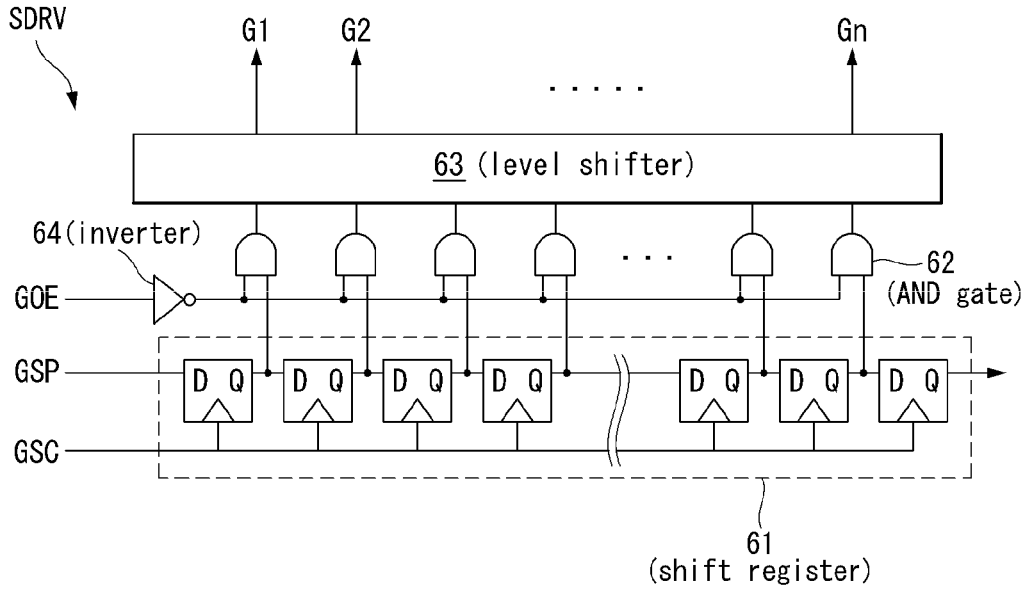
FIG. 2 is a block diagram of a gate driving unit.
Figure 3:
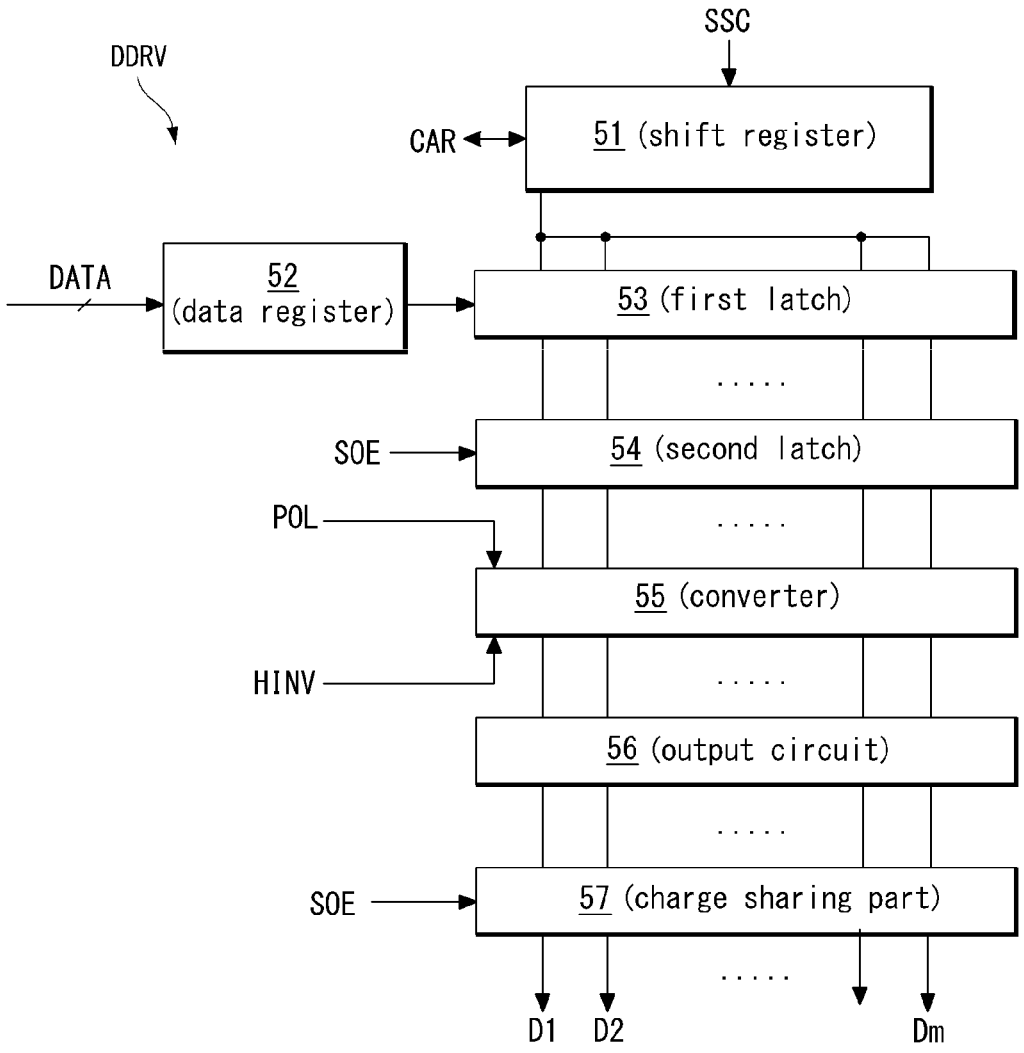
FIG. 3 is a block diagram of a data driving unit.
Figure 4:
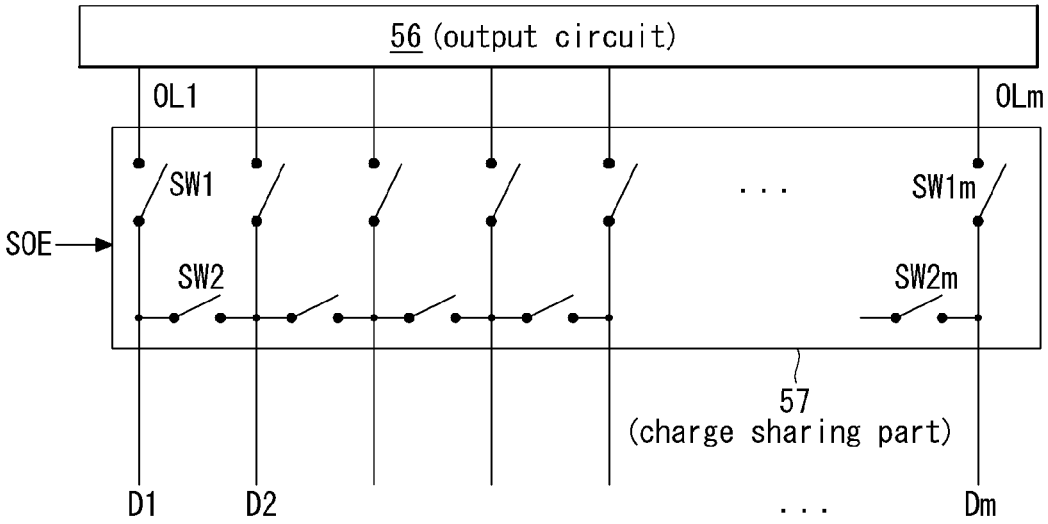
FIG. 4 a block diagram illustrating a charge sharing part.

FIG. 1 is a block diagram of a LCD device according to one embodiment of the present invention, FIG. 2 is a block diagram of a gate driving unit, FIG. 3 is a block diagram of a data driving unit, and FIG. 4 a block diagram illustrating a charge sharing part.

As described in FIG. 1, the LCD device according to one embodiment includes a timing control unit TCN, a power supply unit PWR, a data driving unit DDRV, a gate driving unit SDRV, a LCD panel PNL, and a backlight unit BLU.

The timing control unit TCN receives a vertical synchronous signal Vsync, a horizontal synchronous signal Hsync, a date enable signal DE and a data signal DATA. The timing control unit TCN controls the operation timing of the data driving unit DDRV and the gate driving unit SDRV by using the vertical synchronous signal Vsync, the horizontal synchronous signal Hsync, the date enable signal DE, and the like. As the timing control unit TCN can determine a frame period by counting data enable signals DE of 1 horizontal period, the vertical synchronous signal and the horizontal synchronous signal supplied from the outside can be omitted. The representative control signals generated from the timing control unit TCN include a gate timing control signal GDC for controlling the operation timing of the gate driving unit SDRV and a data timing control signal DDC for controlling the operation timing of the data driving unit DDRV. The gate timing control signal includes a gate start pulse GSP, a gate shift clock GSC, a gate output enable signal GOE, and the like. The gate start pulse GSP is supplied to a gate drive Integrated Circuit (IC) for generating a first gate signal. The gate shift clock GSC is a clock signal which is commonly inputted into the gate drive ICs and shifts the gate start pulse GSP. The gate output enable signal GOE controls the outputs of the gate drive ICs. The data timing control signal includes a source start pulse SSP, a source sampling clock SSC, a source output enable SOE, and the like. The source start pulse SSP controls a data sampling starting point of the data driving unit. The source sampling clock SSC is a clock signal for controlling a sampling operation of data within the data driving unit DDRV on the basis of a rising or falling edge. The source output enable SOE signal controls an output of the data driving unit DDRV. Meanwhile, the source start pulse SSP supplied to the data driving unit DDRV can be omitted according to a data transmission manner.

The power supply unit PWR generates a driving voltage by adjusting a voltage Vin supplied from a system board and supplies the driving voltage to one or more of the timing control unit TCN, the data driving unit DDRV, the gate driving unit SDRV, and the LCD panel. In addition, the power supply unit PWR generates a common voltage Vcom as well as gamma voltages GMA0~GMAn and supplies the common voltage Vcom and the gamma voltages GMA0~GMAn the data driving unit DDRV and the LCD panel PNL. The power supply unit PWR adjusts a mode for generating an output voltage such as a normal power mode and an ultra low power mode and the like according to a power control signal supplied from the outside.

The LCD panel PNL includes a liquid crystal layer positioned between a transistor substrate (hereinafter, a TFT substrate) and a color filter substrate and includes sub-pixels arranged in a matrix. The TFT substrate includes a data line, a gate line, a TFT, a storage capacitor, and the like. The color filter substrate includes a black matrix, a color filter, and the like. One sub-pixel SP is defined by a data line D1 and a gate line SL1 which intersect with each other. The sub-pixel SP includes a TFT driven by the gate signal supplied through the gate line SL1 a storage capacitor Cst for storing the data signal supplied through the data line DL1 as the data voltage, and a liquid crystal cell Clc driven by the data voltage stored in the storage capacitor Cst. The liquid crystal cell Clc is driven by the data voltage supplied to a pixel electrode 1 and the common voltage VCOM supplied to a common electrode 2. The common electrode is formed on the color filter substrate in a vertical field driving mode such as a Twisted Nematic (TN) mode and a Vertical Alignment (VA) mode. The common electrode and the pixel electrode are formed on the TFT substrate in a horizontal field driving mode such as an In Plane Switching (IPS) mode and a Fringe Field Switching (FFS) mode. A polarization plate is attached to the TFT substrate and the color filter substrate of the LCD panel and an alignment layer for setting a pre-tilt angle of a liquid crystal is formed at the TFT substrate and the color filter substrate of the LCD panel. A liquid crystal mode of the LCD panel PNL can be formed by any liquid crystal mode as well as the above TN mode, the VA mode, the IPS mode, and the FFS mode.

A backlight unit BLU provided the light for the LCD panel PNL. The backlight unit BLU includes a light source circuit part having a DC power portion, light emission portions, transistors, a driving control portion, and the like and an optical instrument part having a cover bottom, a light guide plate, an optical sheet, and the like. The backlight unit BLU can be variously formed with an edge type, a dual type, a direct type, and the like. Here, the edge type is to arrange light emitting diodes in a shape of string on one side of the LCD panel. The dual type is to arrange the light emitting diodes in a shape of string on both sides of the LCD panel. The direct type is to arrange the light emitting diodes in a shape of block or a shape of string on a lower part of the LCD panel PNL.

The gate driving unit SDRV generates sequentially gate signals by shifting levels of signals in a swing width of a gate driving voltage capable of operating the transistors of the sub-pixels SP included in the LCD panel PNL in response to the gate timing control signal GDC supplied from the timing control unit TCN. The gate driving unit SDRV supplies the gate signals generated through the gate lines GL to the sub-pixels SP included in the LCD panel PNL. The gate driving unit, as described in FIG. 2, is formed with gate drive ICs. Each of the gate drive ICs includes a shift register 61, a level shifter 63, a plurality of logical product gates (hereinafter, AND gate) connected between the shift register 61 and the level shifter 63, an inverter 64 for inverting the gate output enable signal GOE, and the like. The shift register 61 sequentially shifts gate start pulses GSP according to gate shift clocks GSC by using a plurality of D-flipflops to be subordinately connected. Each of the AND gates 62 generates an output by logically multiplying the output signal of the shift register 61 by an inverted signal of the gate output enable signal GOE. The inverter 64 inverts the gate output enable signal GOE and supplies the inverted signal to the AND gates 62. The level shifter 63 shifts a swing width of an output voltage of the AND gate 62 to a swing width of the gate voltage capable of operating the transistors included in the LCD panel PNL.

The data driving unit DDRV converts the data signal DATA supplied from the timing control unit TCN into data of a parallel data system by sampling and latching the data signal DATA in response of the data timing control signal DDC supplied from the timing control unit TCN. The data driving unit DDRV converts the data signal DDRV to a gamma reference voltage when the data signal DATA are converted into the data of the parallel data system. The data driving unit DDRV supplies the data signal DATA converted through the data lines DL to the sub-pixels SP included in the LCD panel PNL. As shown in FIG. 3, the data driving unit DDRV includes a shift register 51, a data register 52, a first latch 53, a second latch 54, a converter 55, an output circuit 56, and the like. The shift register 51 shifts the source sampling clock SSC supplied from the timing control unit TCN. The shift register 51 transfers a carry signal CAR to a shift register of a source drive IC of an adjacent next stage. The data register 52 temporarily stores the data signal DAT supplied from the timing control unit (TCN) and supplies the stored signal to the first latch 53. The first latch 53 samples and latches the serially inputted data signal DATA according to the clock sequentially supplied from the shift register 51 and simultaneously outputs the latched data. The second latch 54 latches the data supplied from the first latch 53, is synchronized with the second latches 54 of other source drive ICs in response to a source output enable signal SOE, and simultaneously outputs the latched data. The converter 55 converts the digital type data signal DATA supplied from the second latch 54 to a positive polarity gamma voltage or a negative polarity gamma voltage in response to a polarity control signal POL and a horizontal inversion signal (HINV) so as to be converted to an analog type data voltage. The output circuit 56 includes a buffer for minimizing the signal attenuation of the data voltage outputted to data lines D1-Dm. A charge sharing part 57 supplies a charge sharing voltage or the common voltage Vcom to the data lines DL during a charge sharing period according to the source output enable signal SOE. As shown FIG. 4, the charge sharing part 57 corresponds to and is connected to the output circuit 56. The charge sharing part includes first switch portions SW1-SW1*m* positioned between output lines OL1-OLm of the output circuit 56 and the data lines D1-Dm and second switch portions SW2-SW2*m* positioned between the data lines D1-Dm. The charge sharing part 57 supplies the charge sharing voltage or the common voltage VCOM to the data lines D1-Dm during a charge sharing period CSP by the first switch portions SW1-SW1*m* and the second switch portions SW2-SW2*m* in response to the charge sharing control signals composed of the source output enable signals SOE.

Hereinafter, the liquid crystal display device according to one embodiment will be explained in detail.

Figure 5:
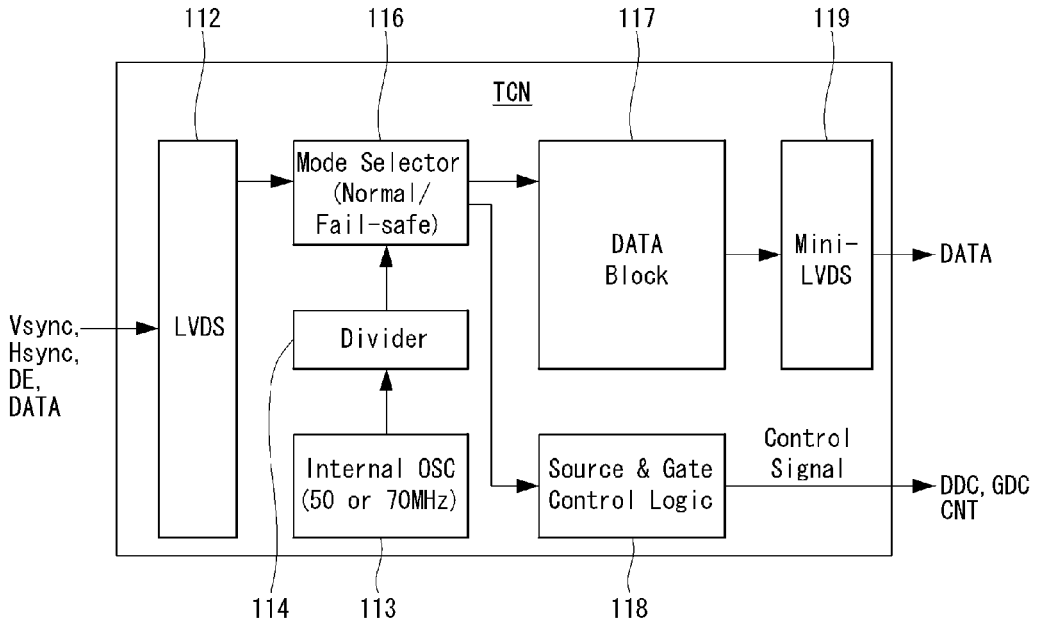
FIG. 5 a block diagram of a timing control unit according to one embodiment of the present invention.
Figure 6:
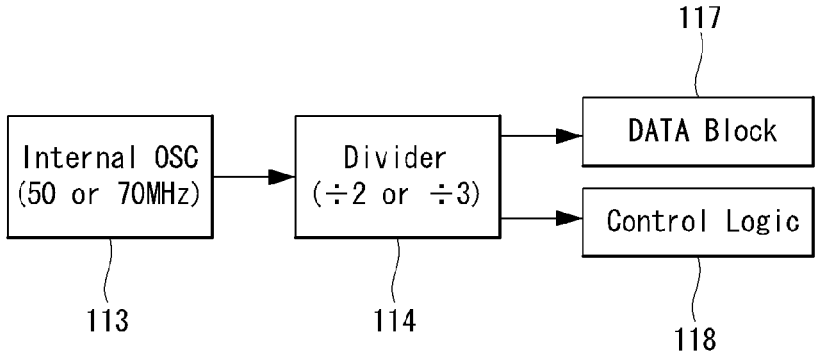
FIG. 6 is a partial block diagram of the timing control unit illustrated in FIG. 5.
Figure 7:
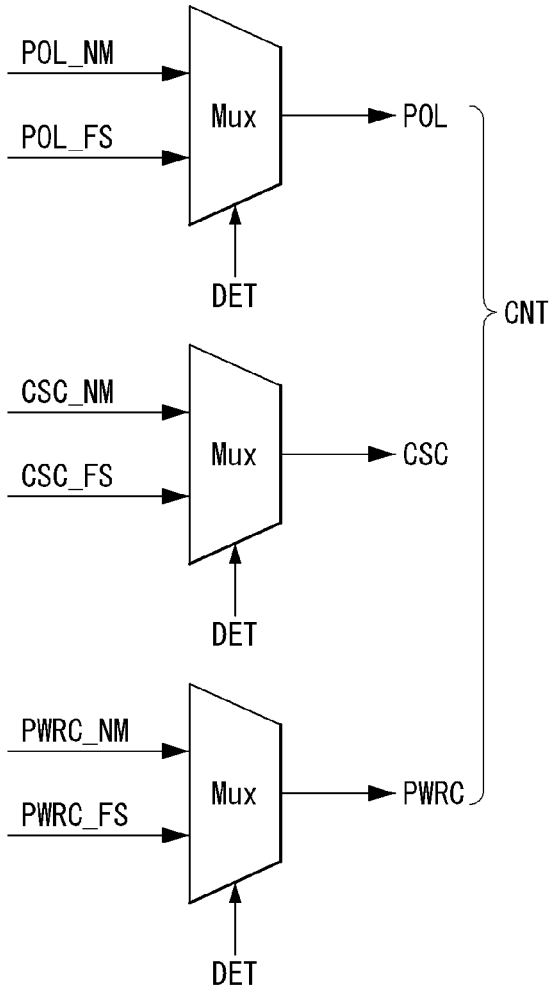
FIG. 7 is a block diagram illustrating a part of internal logic circuits.

FIG. 5 a block diagram of a timing control unit according to one embodiment of the present invention, FIG. 6 is a partial block diagram of the timing control unit illustrated in FIG. 5, FIG. 7 is a block diagram illustrating a part of internal logic circuits, FIG. 8 a view illustrating a 2-dot inversion state, and FIG. 9 is a view illustrating a frame inversion state.

As shown in FIG. 5, the timing control unit TCN includes a Low Voltage Differential Signaling (LVDS) interface part 112, an oscillator 113, a frequency divider 114, a mode selection part 116, a data block 117, a control block 118, and a Mini-LVDS interface part 119.

The LVDS interface part 112 is a device for receiving the vertical synchronous signal Vsync, the horizontal synchronous signal Hsync, the date enable signal DE and the data signal DATA which are supplied from a system board.

The oscillator 113 is a device for generating a necessary frequency clock within the timing control unit TCN. The oscillator 113 generates one frequency clock corresponding to for example 50 Mhz or 70 Mhz.

The frequency divider 114 is a divider for reducing the clock frequency supplied from the oscillator 113 by dividing the clock frequency by 2 or 3.

The mode selection part 116 is a mode selector for changing at least one driving mode of internal logic circuits by using the divided clock frequency supplied from the frequency divider 114.

The data block 117 is a device DATA Block for signal-processing the data signal DATA and the like supplied from the system board and outputting the signal-processed data.

The control block 118 is a device Source & Gate Control Logic which generates the data timing control signal DDC for controlling the data driving unit DDRV, the gate driving unit SDRV, the power supply unit PWR, and the like according to the data signal DATA and the like supplied from the system board, the gate timing control signal GDC, and a control signal Control Signal including the mode selection signal CNT.

The Mini-LVDS interface part 119 is a device Mini-LVDS for transmitting the data signal DATA signal-processed through the data block 117 to the data driving unit DDRV.

As shown in FIG. 6, the timing control unit TCN divides the clock frequency supplied from the frequency divider 114 by 2 or 3 and controls the internal logic circuits including the data block 117 and the control block 118 using the divided clock frequency. The power consumption can be reduced in the particular state by dividing the clock frequency supplied from the frequency divider 114 by 2 or 3 and controlling the internal logic circuits including the data block 117 and the control block 118 using the divided clock frequency.

The timing control unit TCN determines the data signal DATA supplied thereto as a non-signal image and a normal image and controls the mode selection part 116 to change at least one driving mode of the internal logic circuits when the data signal DATA is the non-signal image. The mode selection part 116 is operated in one of a normal mode Normal for driving the internal logic circuits according to the normal image and a fail safe mode Fail-safe for driving the internal logic circuits according to the non-signal image. That is, the mode selection part 116 controls the mode selection signal CNT to change at least one driving mode of the internal logic circuits using the divided clock frequency supplied from the frequency divider 114 when the data signal DATA is the non-signal image. Here, the non-signal image means the composition of signals corresponding to the state that there is no image displayed on the LCD panel.

The mode selection part 116 changes the driving mode to convert the polarity control signal POL outputted from the timing control unit TCN from the 2-dot inversion state to the frame inversion state when the data signal DATA is the non-signal image. For example, if the driving signal is generated in the two-dot inversion state according to each frame when the non-signal image is supplied to the timing control unit TCN as shown in FIGS. 8(*a*) and 8(*b*), the power consumption is increased by the dot inversion of the data signal. However, if the signal supplied to the timing control unit TCN is determined as the non-signal image and the driving signal is generated in the frame inversion state as shown in FIGS. 9(*a*) and 9(*b*), the power consumption can be reduced by avoiding the dot inversion within the same frame.

The mode selection part 116 changes the driving mode to switch the charge sharing control signal outputted from the timing control unit TCN from an active state to an inactive state when the data signal DATA is the non-signal image. For example, the power consumption is increased by controlling the switch portions SW1-SW1*m*, SW2-SW2*m* for the charge-sharing when the data driving unit DDRV continuously charge-shares in the supplying state of the non-signal image to the timing control unit TCN. However, if the signal supplied to the timing control unit TCN is determined as the non-signal image and the charge-sharing control signal is switched to the inactive state, the power consumption can be reduced by omitting the controls for the switch parts SW1-SW1*m*, SW2-SW2*m*.

The mode selection part 116 changes the driving mode to switch the power control signal outputted from the timing control unit TCN from the normal power state Normal power to a ultra low power state Ultra low power when the data signal DATA is the non-signal image. For example, the power consumption is increased by generating the same conditions such as the gamma voltage, the data voltage, the driving voltage of the driving unit and the like when the power supply unit PWR continuously generates the power necessary for driving the normal image in the supplying state of the non-signal image to the timing control unit TCN. However, if the signal supplied to the timing control unit TCN is determined as the non-signal image and the output voltage of the power supply unit PWR is switched from the normal power state to the ultra low power state, the power consumption can be reduced by minimizing the output voltage.

Meanwhile, the mode selection part 116 generates the divided clock frequency supplied from the frequency divider 114 as the vertical synchronous signal Vsync and can use the count value of the vertical synchronous signals Vsync as a control signal DET for changing at least one driving mode of the internal logic circuits so as to perform the above described operation. The mode selection part 116 does not change at least one driving mode of the internal logic circuits when the count value is "0" and can change at least one driving mode of the internal logic circuits when the count value is "1". Accordingly, when the control signal DET is "0", POL_NM, CSC_NM, and PWRC_NM are selectively outputted in the polarity control signal POL, the charge sharing control signal CSC, and the power control signal PWRC and at least one of the devices connected therewith are driven in the normal mode Normal. In addition, when the control signal DET is "1", POL_FS, CSC_FS, and PWRC_FS are selectively outputted in the polarity control signal POL, the charge sharing control signal CSC, and the power control signal PWRC and at least one of the devices connected therewith are driven in the fail safe mode Fail-safe. At this time, the driving mode according to the state of "0" or "1" of the control signal DET can be set opposite to the above description.

As described above, the present invention has an effect for providing the LCD device which can reduce the power consumption in comparison with the normal image driving state by changing the driving frequency in the inputting state of the non-signal image and changing the driving mode of the internal logic circuits of the timing control unit related to the power consumption in the data driving unit. Thus, the present invention can reduce the power of 528 mW in the black image through the change of the driving frequency in the inputting state of the non-signal image and can obtain an effect for reducing the power of total 429 mW in the black image of 60 Hz through the change of the power option in the data driving unit, as a result of simulation.

The foregoing embodiments and advantages are merely exemplary and are not to be construed as limiting the present invention. The present teaching can be readily applied to other types of apparatuses. The description of the foregoing embodiments is intended to be illustrative, and not to limit the scope of the claims. Many alternatives, modifications, and variations will be apparent to those skilled in the art. In the claims, means-plus-function clauses are intended to cover the structures described herein as performing the recited function and not only structural equivalents but also equivalent structures.

What is claimed is:

1. A LCD device, comprising:

a timing control unit;

an oscillator which is included in the timing control unit and generates a clock frequency;

a frequency divider which is included in the timing control unit and reduces the clock frequency supplied from the oscillator by dividing the clock frequency by at least 2; and a mode selection part which is included in the timing control unit and changes at least one driving mode of internal logic circuits by using the divided clock frequency supplied from the frequency divider, wherein the mode selection part changes a driving mode to switch a power control signal outputted from the timing control unit from a normal power state to an ultra low power state when a data signal is a non-signal image;

wherein the mode selection part generates a divided clock frequency supplied from the frequency divider as a vertical synchronous signal and uses a count value of the vertical synchronous signal as a control signal for changing at least one driving mode of the internal logic circuits; and wherein the mode selection part does not change at least one driving mode of the internal logic circuits when the count value is "0" and changes at least one driving mode of the internal logic circuits when the count value is "1".

2. The LCD device of claim 1, wherein the timing control unit determines the data signal supplied thereto as one of the non-signal image and a normal image and changes at least one driving mode of the internal logic circuits when the data signal is the non-signal image.

3. The LCD device of claim 1, wherein the timing control unit is operated in one of a normal mode for driving the internal logic circuits according to the normal image and a fail safe mode for driving the internal logic circuits according to the non-signal image.

4. The LCD device of claim 1, wherein the mode selection part changes at least one driving mode of the internal logic circuits using the divided clock frequency supplied from the frequency divider when the data signal is the non-signal image.

5. The LCD device of claim 1, wherein the mode selection part changes a driving mode to convert a polarity control signal outputted from the timing control unit from a 2-dot inversion state to a frame inversion state when the data signal is the non-signal image.

6. The LCD device of claim 1, wherein the mode selection part changes a driving mode to switch a charge sharing control signal outputted from the timing control unit from an active state to an inactive state when the data signal is the non-signal image.

7. A method for driving a LCD device includes the steps of:

controlling a frequency divider to reduce a clock frequency supplied from an oscillator included in a timing control unit by dividing the clock frequency by at least 2; and changing at least one driving mode of internal logic circuits by using the reduced clock frequency divided by at least 2, determining a data signal as a non-signal image and a normal image, changing at least one driving mode of the internal logic circuits when the data signal is the non-signal image, wherein the step of changing the driving mode is to change the driving mode to switch a power control signal outputted from the timing control unit from a normal power state to an ultra low power state when the data signal is the non-signal image;

wherein the step of reducing the clock frequency by at least 2 is to generate the clock frequency divided and reduced by at least 2 as a vertical synchronous signal and to change at least one driving mode of the internal circuits by using a count value of the vertical synchronous signal; and wherein at least one driving mode of the internal logic circuits are not changed when the count value is "0" and at least one driving mode of the internal logic circuits are changed when the count value is "1".

8. The method for driving the LCD device of claim 7, wherein the step of changing the driving mode is to perform an operation in one of a normal mode for driving the internal logic circuits according to the normal image and a fail safe mode for driving the internal logic circuits according to the non-signal image.

9. The method for driving the LCD device of claim 7, wherein the step of changing the driving mode is to change the driving mode to switch a polarity control signal outputted from the timing control unit from a two-dot inversion state to a frame inversion state when the data signal is the non-signal image.

10. The method for driving the LCD device of claim 7, wherein the step of changing the driving mode is to change the driving mode to switch a charge sharing control signal outputted from the timing control unit from an active state to an inactive state when the data signal is the non-signal image.

* * * * *